US011511557B2

(12) United States Patent
Kutsuwa et al.

(10) Patent No.: US 11,511,557 B2
(45) Date of Patent: Nov. 29, 2022

(54) INKJET RECORDING MEDIUM

(71) Applicant: Nippon Paper Industries Co., Ltd., Tokyo (JP)

(72) Inventors: Koji Kutsuwa, Tokyo (JP); Tadashi Yoshida, Tokyo (JP); Kentaro Kawasaki, Tokyo (JP)

(73) Assignee: Nippon Paper Industries Co., Ltd., Tokyo (JP)

( * ) Notice: Subject to any disclaimer, the term of this patent is extended or adjusted under 35 U.S.C. 154(b) by 0 days.

(21) Appl. No.: 16/644,717

(22) PCT Filed: Aug. 31, 2018

(86) PCT No.: PCT/JP2018/032321
§ 371 (c)(1),
(2) Date: Mar. 5, 2020

(87) PCT Pub. No.: WO2019/049779
PCT Pub. Date: Mar. 14, 2019

(65) Prior Publication Data

US 2020/0282756 A1 Sep. 10, 2020

(30) Foreign Application Priority Data

Sep. 5, 2017 (JP) ..... JP2017-170036

(51) Int. Cl.
*B41M 5/52* (2006.01)
*B41J 3/60* (2006.01)
*B41M 5/50* (2006.01)

(52) U.S. Cl.
CPC ..... *B41M 5/5218* (2013.01); *B41J 3/60* (2013.01); *B41M 5/502* (2013.01); *B41M 2205/38* (2013.01)

(58) Field of Classification Search
CPC ..... B41M 5/50; B41M 5/502; B41M 5/52; B41M 5/5218; B41M 5/5245; B41M 5/5254; B41M 2205/34; B41M 2205/38; B41J 3/60
See application file for complete search history.

(56) References Cited

U.S. PATENT DOCUMENTS 5,460,874 A 10/1995 Rao
5,474,843 A 12/1995 Lambert et al.
6,357,871 B1 * 3/2002 Ashida ..... B41J 2/01 347/101
7,147,901 B2 * 12/2006 Kasamatsu ..... B41M 5/504 428/32.25
9,242,497 B2 1/2016 Watanabe et al.
10,549,565 B2 2/2020 Kutsuwa et al.
2001/0012556 A1 * 8/2001 Kondo ..... B41M 5/5218 428/32.24
2005/0179759 A1 * 8/2005 Yoshida ..... B41M 5/52 347/105
2008/0160232 A1 * 7/2008 Sasaguri ..... B41M 5/52 428/32.33
2009/0035489 A1 * 2/2009 Kaimoto ..... B41M 5/502 428/32.1
2011/0059273 A1 * 3/2011 Nakano ..... B41M 5/52 428/32.28
2013/0243977 A1 * 9/2013 Zhou ..... G03G 7/0026 428/32.11
2017/0259602 A1 9/2017 Kutsuwa et al.
2020/0406658 A1 12/2020 Hirai

FOREIGN PATENT DOCUMENTS

CN 1638971 A 7/2005
EP 1078774 A2 2/2001
EP 1484188 A1 12/2004
EP 3680111 A1 7/2020
JP 2002-292997 10/2002
JP 2003-285545 A 10/2003
JP 2004-276486 10/2004
JP 2005-280012 A 10/2005
JP 2009-125954 6/2009
JP 2010-30216 A 2/2010
(Continued)

OTHER PUBLICATIONS

European Search Report corresponding to European Application No. 18854024 dated Nov. 24, 2020.
(Continued)

*Primary Examiner* — Christopher M Polley
*Assistant Examiner* — Sathavaram I Reddy
(74) *Attorney, Agent, or Firm* — Jenkins, Wilson, Taylor & Hunt, P.A.

(57) ABSTRACT

An inkjet recording medium, comprising an ink-receiving layer containing an inorganic pigment, a binder, an inkjet ink-fixing agent comprising a cationic compound, and organic spherical particles disposed on at least one surface of a base paper, wherein the ink-receiving layer further contains a water-soluble metal salt and 5 parts by weight or more to 15 parts by weight or less of polyvinyl alcohol (A) with a polymerization degree of 700 or less and 20 parts by weight or more to 40 parts by weight or less of polyvinyl alcohol (B) with a polymerization degree of 1200 or more as the binder with respect to 100 parts by weight of the ink-receiving layer; and a volume 50% average particle diameter (D50) as measured by a laser diffraction/scattering method of the organic spherical particles is 15.0 μm or more.

19 Claims, No Drawings

(56) References Cited

FOREIGN PATENT DOCUMENTS

| | | |
|---|---|---|
| JP | 06-278357 | 2/2018 |
| WO | WO 2003/076203 A1 | 9/2003 |

OTHER PUBLICATIONS

International Search Report corresponding to International Patent Application No. PCT/JP2018/032321 dated Nov. 13, 2018.
Written Opinion of the International Searching Authority corresponding to International Patent Application No. PCT/JP2018/032321 dated Nov. 13, 2018.
International Preliminary Report on Patentability corresponding to International Patent Application No. PCT/JP2018/032321 dated Mar. 10, 2020.

* cited by examiner

INKJET RECORDING MEDIUM

FIELD OF THE INVENTION

The present invention relates to an inkjet recording medium.

DESCRIPTION OF THE RELATED ART

In recent years, an inkjet recording method has been increasingly popular as it is easy to perform a full color printing and a printing noise is suppressed. This method records images and characters by flying and depositing microdroplets of ink at high speed from a nozzle to a recording medium. Thus, multicolor printing and high definition are easily achieved. In particular, in a high resolution full color printer in recent years, an image almost comparable to color printing and a silver-halide photo is printable. Then, a number of inkjet printers is now introduced into ordinary homes, and is used in an application in which an image mainly from a digital camera is printed by inkjet recording to create a direct mail card, a New Year's postcard, etc.

However, since a processing time of the inkjet printer for home is longer than that of an offset printer or the like, the inkjet recording is difficult to be commercially available. In order to solve this problem, a line-head printer appears that significantly shortens the processing time mainly for a commercial purpose, i.e., can print at high speed (for example, see Patent Literature 1). The line-head printer includes linearly-arranged ink heads under which an inkjet recording medium is conveyed at high speed on a belt different from a conventional inkjet printer that prints by moving ink heads. Thus, the processing time for each medium is several seconds, even one second or less. It is possible to print at excessively high speed as compared with the inkjet printer for home. In addition, the line-head printer has a mechanism that inverts the recording medium within the printer and can double-sided print. However, while it is possible to double-sided print or high speed print, properties needed for the recording medium become higher.

If a conveyance property of the inkjet recording medium is not good, troubles arise that empty feeding occurs, in which no inkjet recording medium is conveyed into the printer, or multi-feeding occurs, in which a plurality of inkjet recording media is conveyed. In particular, the coefficient of friction among the inkjet recording media layered becomes high under high temperature and high humidity conditions, and the multi-feeding may easily occur. This is a problem in the inkjet printer for home and is a critical problem especially in a commercially available high speed feeding printer adapted to high-speed printing.

Furthermore, there is disclosed a method of decreasing the coefficient of static friction between front and back sides of the inkjet printing medium by containing organic spherical particles in an ink-receiving layer (see Patent Literature 3). However, the method targets the inkjet printer for home and is not desirable for the commercially available high speed feeding printer.

[Patent Literature 1] Japanese Unexamined Patent Publication No. 2004-276486

[Patent Literature 2] Japanese Unexamined Patent Publication No. Hei 06-278357

[Patent Literature 1] Japanese Unexamined Patent Publication No. 2002-292997

SUMMARY OF INVENTION

Problems to be Solved by the Invention

Incidentally, especially when the inkjet recording medium is used in a line-head high speed feeding printer, a printer conveyance property is needed under high temperature and high humidity conditions. The high temperature refers to, e.g., 30° C. or more, and the high humidity refers to, e.g., 80% RH or more.

Means for Solving the Problems

Through intense studies by the present inventors in order to solve the above-described problems, it is possible to achieve the object of the present invention by using the following configurations.

That is, the present invention provides an inkjet recording medium, comprising an ink-receiving layer containing an inorganic pigment, a binder, an inkjet ink-fixing agent comprising a cationic compound, and organic spherical particles disposed on at least one surface of a base paper, wherein the ink-receiving layer further contains a water-soluble metal salt and 5 parts by weight or more to 15 parts by weight or less of polyvinyl alcohol (A) with a polymerization degree of 700 or less and 20 parts by weight or more to 40 parts by weight or less of polyvinyl alcohol (B) with a polymerization degree of 1200 or more as the binder with respect to 100 parts by weight of the ink-receiving layer; and a volume 50% average particle diameter (D50) as measured by a laser diffraction/scattering method of the organic spherical particles is 15.0 μm or more.

Preferably, the volume 50% average particle diameter (D50) of the organic spherical particles may exceed 20.0 μm and is 35.0 μm or less.

Preferably, 0.5 parts by weight or more to 7 parts by weight or less of the organic spherical particles may be contained with respect to 100 parts by weight of the inorganic pigment.

Preferably, a cation of the water-soluble metal salt may be one selected from the group consisting of a magnesium ion, a calcium ion, and an aluminum ion, and an anion is one selected from the group consisting of a sulfate ion, a nitrate ion, and a chloride ion.

Preferably, 3 to 15 parts by weight of the water-soluble metal salt may be contained with respect to 100 parts by weight of the ink-receiving layer.

Preferably, the inorganic pigment may contain synthesized amorphous silica with a volume 50% average particle diameter (D50) of 6 to 14 μm, and the synthesized amorphous silica may occupy 60% by weight of the inorganic pigment.

Preferably, the ink-receiving layers may be disposed on both surfaces of the base paper.

Effects of the Invention

According to the present invention, there is provided an inkjet recording medium having a high color development property and an excellent printer conveyance property even under high temperature and high humidity conditions when the inkjet recording medium is especially used in a line-head high speed feeding printer.

DESCRIPTION OF THE EMBODIMENTS

An ink-receiving layer according to the present invention contains an inorganic pigment, a binder, an inkjet ink-fixing agent comprising a cationic compound, and organic spherical particles.

According to the present invention, there is provided an inkjet recording medium having the high color development property and the excellent printer conveyance property even under high temperature and high humidity conditions when the inkjet recording medium is especially used in a line-head high speed feeding printer. The reason is as follows:

As a cause of a conveyance trouble of the printer, it is conceivable that the coefficient of friction among the inkjet recording media layered is not within a proper range. In a case where the coefficient of friction, in particular, the coefficient of static friction, is too high, the inkjet recording media do not slide well each other, a number of the inkjet recording media are misaligned in the printer, and the multi-feeding occurs in which the plurality of inkjet recording media is overlapped and conveyed. In contrast, in a case where the coefficient of friction, in particular, the coefficient of static friction, is too low, the inkjet recording media slide excessively, and the empty feeding occurs in which no inkjet recording medium is conveyed into the printer. Especially under high temperature and high humidity conditions, the coefficient of friction, in particular, the coefficient of static friction specifically tends to be high, and the multi-feeding thus easily occurs.

Accordingly, in order to adjust the coefficient of friction between front and back sides of the inkjet printing medium within the proper range even under high temperature and high humidity conditions, the ink-receiving layer is configured as described above.

As the inorganic pigment used in the ink-receiving layer according to the present invention, conventionally known white pigment may be used. Examples include precipitated calcium carbonate, ground calcium carbonate, kaolin, calcined kaolin, clay, talc, calcium sulfate, barium sulfate, titanium dioxide, zinc oxide, zinc sulfide, zinc carbonate, satin white, aluminum silicate, diatomaceous earth, calcium silicate, magnesium silicate, synthesized amorphous silica, colloidal silica, colloidal alumina, boehmite, pseudo boehmite, aluminum oxide, alumina, lithopone, zeolite, hydrated halloysite, magnesium carbonate, and magnesium hydroxide.

Among them, the ink-receiving layer preferably contains synthesized amorphous silica with a volume 50% average particle diameter (D50) measured by a laser diffraction/scattering method of 6 to 14 μm and the synthesized amorphous silica occupies 60% by weight or more of the whole inorganic pigment. Thus, the inkjet recording medium having good printing quality can be provided.

If the D50 of the synthesized amorphous silica is under 6 μm, an ink absorption property may be insufficient and the printing quality may be lowered. On the other hand, if the D50 of the synthesized amorphous silica exceeds 14 μm, voids among inorganic pigment particles may be excessively increased, the ink absorption property may be excessive, and printing density may be lowered.

All (100% by weight) of the inorganic pigment in the ink-receiving layer may be synthesized amorphous silica.

Here, as a measuring apparatus of the laser diffraction/scattering method, there are a particle size distribution measuring device "Partica" manufactured by HORIBA, Ltd. and a grain size distribution measuring device "MASTER SIZER S" manufactured by MALVERN Instruments Ltd., etc.

Examples of the organic spherical particles used in the ink-receiving layer according to the present invention include spherical particles of typical organic matters such as polyamide resin, polyester resin, polycarbonate resin, polyether resin, polyolefin resin, polysulfone-based resin, polystyrene-based resin, polyurethane-based resin, polyacrylic-based resin, polyvinyl chloride-based resin, polyvinylidene chloride-based resin, ethylene-vinyl acetate copolymer resin, and styrene copolymer resin.

Here, the organic spherical particles are used for decreasing the coefficient of friction of the ink-receiving layer and ensuring the printer conveyance property.

According to the present invention, the volume 50% average particle diameter (D50) as measured by the laser diffraction/scattering method of the organic spherical particles is set to 15.0 μm or more, to thereby being difficult to bury the organic spherical particles into the ink-receiving layer. If the average particle diameter D50 is under 15.0 μm, the organic spherical particles are easily buried into the ink-receiving layer and an effect of decreasing the coefficient of friction is insufficient.

Furthermore, the average particle diameter of the organic spherical particles preferably exceeds 20.0 μm and is 35.0 μm or less, more preferably from 22.0 μm to 30.0 μm.

If the average particle diameter exceeds 35.0 μm, an effect of decreasing, in particular, the coefficient of dynamic and static friction is excessive, and the empty feeding may easily occur.

The average particle diameter of the organic spherical particles is measured by the laser diffraction/scattering method. The measuring device of the laser diffraction/scattering method is as described above.

In addition, preferably 0.5 parts by weight or more to 7 parts by weight or less, more preferably 1.5 parts by weight or more to 5.5 parts by weight or less of the organic spherical particles are contained in the ink-receiving layer with respect to 100 parts by weight of the inorganic pigment. If the organic spherical particles are contained in the amount of under 0.5 parts by weight, an effect of decreasing, in particular, the coefficient of static friction is small, and the multi-feeding may easily occur. On the other hand, if the content of the organic spherical particles exceeds 7 parts by weight, the coefficient of dynamic and static friction is excessive, and the empty feeding may easily occur.

According to the present invention, the ink-receiving layer further contains a water-soluble metal salt described later, 5 parts by weight or more to 15 parts by weight or less of polyvinyl alcohol (PVA) (A) with a polymerization degree of 700 or less, and 20 parts by weight or more to 40 parts by weight or less of polyvinyl alcohol (B) with a polymerization degree of 1200 or more as the binder with respect to 100 parts by weight of the ink-receiving layer.

When the ink-receiving layer contains a specific amount of the polyvinyl alcohol (B), it will be easy to provide both of the strength and the ink absorption property of the ink-receiving layer. On the other hand, when the ink-receiving layer contains no polyvinyl alcohol (A), the water-soluble metal salt acts on the polyvinyl alcohol (B), a coating of the polyvinyl alcohol (B) is attached around the organic spherical particles, and the organic spherical particles are buried into the ink-receiving layer and have less chance to appear on the surface. As a result, it seems that the effect of decreasing the coefficient of friction may be small even through the ink-receiving layer contains the organic spherical particles.

On the other hand, if the water-soluble metal salt acts on the polyvinyl alcohol (A), a coating of the polyvinyl alcohol (A) formed is thinner than that of the polyvinyl alcohol (B). Thus, when the ink-receiving layer contains a specific amount of the polyvinyl alcohol (A), the above-described organic spherical particles are prevented from being buried, and the effect of decreasing the coefficient of friction of the ink-receiving layer becomes great.

If the polyvinyl alcohol (A) is contained in the amount of under 5 parts by weight, the above-described organic spherical particles are not sufficiently prevented from being buried. On the other hand, if the content of the polyvinyl alcohol (A) exceeds 15 parts by weight, an effect of the water-soluble metal salt described later, i.e., an improvement of printability when using pigment ink, is impaired. In particular, the printing density by a pigment printer is low.

If the polyvinyl alcohol (B) is contained in the amount of under 20 parts by weight, the strength of the ink-receiving layer is insufficient, and it is difficult to handle the inkjet recording medium. On the other hand, if the content of the polyvinyl alcohol (B) exceeds 40 parts by weight, the ink absorption property is insufficient, and the printing quality is low.

In particular, if the polyvinyl alcohol (A) is preferably contained in the amount of 10 parts by weight or more, the organic spherical particles are prevented from being buried, the effect of decreasing the coefficient of friction of the ink-receiving layer is provided with certainly, and the multi-feeding of the printer is decreased.

As the polyvinyl alcohol (A) and the polyvinyl alcohol (B) according to the present invention, conventionally known polyvinyl alcohols such as fully saponified polyvinyl alcohol, partly saponified polyvinyl alcohol, carboxyl-modified polyvinyl alcohol, diacetone-modified polyvinyl alcohol, acetoacetyl-modified polyvinyl alcohol, amide-modified polyvinyl alcohol, sulfonate-modified polyvinyl alcohol, butyral-modified polyvinyl alcohol, olefin-modified polyvinyl alcohol, nitrile-modified polyvinyl alcohol, pyrolidone-modified polyvinyl alcohol, silanol-modified polyvinyl alcohol, cation-modified polyvinyl alcohol, and terminal alkyl-modified polyvinyl alcohol can be used.

Examples of the binder used in the ink-receiving layer according to the present invention other than the above-described polyvinyl alcohols include the above polyvinyl alcohols excluding the polyvinyl alcohols (A) and (B); cellulose ethers including hydroxyethyl cellulose, methyl cellulose, ethyl cellulose, carboxy methyl cellulose, acetyl cellulose and a derivative thereof; starches including starch, enzyme-modified starch, thermochemically-modified starch, oxidized starch, esterified starch, etherified starch (for example, hydroxyethylated starch), and cationized starch; polyacrylamides including polyacrylamide, cationized polyacrylamide, anionized polyacrylamide, and amphoteric polyacrylamide; urethane based resins including polyester polyurethane based resin, polyether polyurethane based resin, and polyurethane based ionomer resin; acrylic based resin including (meta)acrylic acid and a monomer component (excluding olefin) copolymerizable with (meta)acrylic acid; styrene-butadiene based resin including styrene-butadiene copolymer, styrene-butadiene-acrylonitrile copolymer, styrene-butadiene-acryl copolymer; polyolefin based resin including polyvinyl acetate, vinyl chloride-vinyl acetate copolymer, and ethylene-vinyl acetate copolymer; polyvinyl chloride, polyvinylidene chloride, polyacrylic ester; gum Arabic; polyvinyl butyral; polystyrol and a copolymer thereof; silicone resin; petroleum resin; terpene resin; ketone resin; and coumarone resin. These binders may be used alone or in combination with two or more thereof, as long as the advantages of the present invention are provided.

The ink-receiving layer according to the present invention contains the inkjet ink-fixing agent comprising the cationic compound in order to improve printability especially in a dye printer.

Examples of the inkjet ink-fixing agent comprising the cationic compound used in the ink-receiving layer according to the present invention include diamines, triamines, and quaternary ammonium salts such as a polyethyleneimine salt, a dimethylamine epihalohydrin condensation product, a polyvinyl amine salt, a polyallyl amine salt, a polydimethyl aminoethyl methacrylate quaternary salt, a polydiallyl dimethyl ammonium salt, a diallylamine acrylic amide copolymer salt, and a quaternary ammonium salt of polystyrene. These may be used alone or in combination with two or more thereof.

According to the present invention, 3 parts by weight or more to 15 parts by weight or less of the inkjet ink-fixing agent is preferably contained with respect to 100 parts by weight of the ink-receiving layer. If the inkjet ink-fixing agent is contained in the amount of under 3 parts by weight, it is difficult to sufficiently improve the printability in the dye printer. On the other hand, if the content of the inkjet ink-fixing agent exceeds 15 parts by weight, the ink absorption property may be insufficient and the printing quality may be lowered.

Incidentally, the printability in the dye printer includes the printing density and water resistance.

The ink-receiving layer according to the present invention contains the water-soluble metal salt in order to improve printability especially in a pigment printer.

Preferably, a cation of the water-soluble metal salt is one selected from the group consisting of a magnesium ion, a calcium ion, and an aluminum ion, and an anion is one selected from the group consisting of a sulfate ion, a nitrate ion, and a chloride ion. Examples of the water-soluble metal salt include magnesium sulfate, calcium sulfate, aluminum sulfate, magnesium nitrate, and magnesium chloride.

According to the present invention, 3 parts by weight or more to 15 parts by weight or less of the water-soluble metal salt is preferably contained with respect to 100 parts by weight of the ink-receiving layer. If the water-soluble metal salt is contained in the amount of under 3 parts by weight, it is difficult to sufficiently improve the printability in the pigment printer. On the other hand, if the content of the water-soluble metal salt exceeds 15 parts by weight, the water-soluble metal salt easily acts on the polyvinyl alcohol (B), the effect of decreasing the coefficient of friction of the ink-receiving layer may be small Incidentally, the printability in the pigment printer includes the printing density.

To the ink-receiving layer according to the present invention, a sizing agent, a pigment dispersant, a thickener, a flow improver, a surfactant, a defoamer, a foam inhibitor, a mold release agent, a foaming agent, a penetrant, a coloring dye, a fluorescent brightener, an ultraviolet absorber, an antioxidant, a preservative, an anti-mold agent, a water resistant agent, a wet paper strengthening agent, a dry paper strengthening agent, a water retention agent, and the like can be included as necessary and as appropriate, as long as the advantages of the present invention are provided.

The inkjet recording medium according to the present invention includes the ink-receiving layer disposed on at least one surface of the base paper. The base paper is not particularly limited. As the base paper, paper mainly composed of wood pulp is preferably used. Examples of the wood pulp include chemical pulp (unbleached or bleached softwood kraft pulp, unbleached or bleached hardwood kraft pulp etc.), mechanical pulp (ground pulp, thermomechanical pulp, chemithermomechanical pulp, etc.), and de-inked pulp. They can be used alone or by mixing at any proportion.

It is preferable that the base paper includes a filler for improving opacity and smoothness of the base paper. Examples of the filler include any known fillers such as hydrated silica, white carbon, talc, kaolin, clay, calcium carbonate, titanium oxide, and synthetic resin filler. In addition, these can be used in combination in response to the required quality.

A pH for base paper making may be any of acidic, neutral, and alkaline. A basis weight of the base paper is not particularly limited. Furthermore, the base paper may contain an auxiliary agent such as aluminum sulfate, a sizing agent, a paper strengthening agent, a retention aid, a colorant, a dye, a defoamer, a pH adjusting agent as appropriate, as long as the advantages of the present invention are provided.

The base paper may be impregnated or coated with sizing liquid containing starch, polyvinyl alcohol, and a sizing agent in order to strengthen the paper and impart sizing properties. In addition, the sizing liquid may contain an auxiliary agent such as a fluorescent dye, a conductive agent, a water retention agent, a water resistant agent, a pH adjusting agent, a defoamer, a lubricant, a preservative, and a surfactant as appropriate, as long as the advantages of the present invention are provided. Although a method of impregnating or coating the sizing liquid is not particularly limited, examples include an impregnating method represented by a pond size press or a coating method represented by a rod metering size press, a gate roll coater, and a blade coater.

According to the present invention, a total number and a structure of the ink-receiving layer(s) disposed on the base paper are not particularly limited. The coating weight (dry coating weight) of the ink-receiving layer is preferably 4 $g/m^2$ to 10 $g/m^2$, more preferably 5 $g/m^2$ to 9 $g/m^2$ for one surface.

If the coating weight of the ink-receiving layer is under 4 $g/m^2$, the ink absorption property may be insufficient and the printing quality may be lowered. On the other hand, if the coating weight of the ink-receiving layer exceeds 10 $g/m^2$, the ink absorption property may be excessive, the printing density may be lowered, the organic spherical particles may be buried into the ink-receiving layer, and the effect of decreasing the coefficient of friction of the ink-receiving layer may be small.

According to the present invention, In order to dispose the ink-receiving layer on the surface of the base paper, a variety of general coating apparatuses can be used in on-machine or off-machine. Examples of the coating apparatuses include every kind of a blade coater, a roll coater, an air knife coater, a bar coater, a gate roll coater, a curtain coater, a gravure coater, a flexographic gravure coater, a spray coater, a size press, and the like. In addition, after the ink-receiving layer is coated, it is also possible to surface-treat the ink-receiving layer by using a calender apparatus such as a machine calender, a super calender, and a soft calender.

Examples

The present invention is explained in further detail by presenting specific examples below, but the present invention is not limited by these examples. Further, unless otherwise specified, the terms "parts" and "%" described below indicate "parts by weight" and "% by weight", respectively.

(Base Paper)

100 parts of bleached hardwood kraft pulp (LBKP) having a CSF (Canadian Standard Freeness) of 340 ml were used as a pulp material. 0.4 parts of a paper strengthening agent (cationized starch), 0.4 parts of aluminum sulfate, and 16 parts of calcium carbonate were added to 100 parts of the pulp to provide a paper stock by using a Fourdrinier papermaking machine. Thereafter, both surfaces of the paper stock were coated with liquid containing 7% of oxidized starch by using the size press so that the dry coating weight was 3 $g/m^2$ on the both surfaces. After drying, machine calendering processing was performed to provide the base paper having a basis weight of 94 $g/m^2$.

Note that "basis weight" in each of Table is based on a value of the inkjet recording medium after the ink-receiving layer is coated.

(Ink-Receiving Layer)

A coating color used in each of Example and Comparative Example was prepared by mixing the following in a ratio shown in Table 1 and adding an adequate amount of dilution water:

Inorganic pigment: Gel silica, i.e., synthesized amorphous silica, (product name: BS-308N: average particle diameter D50=10.0 μm, manufactured by DSL. Japan Co., Ltd.), Precipitated silica (product name: X-60: average particle diameter D50=7.0 μm, manufactured by Oriental Silicas Corporation)

Binder: Polyvinyl alcohol (A) (product name: GL-05: polymerization degree of 500, manufactured by The Nippon Synthetic Chemical Industry Co., Ltd.), Polyvinyl alcohol (B) (product name: PVA117: polymerization degree of 1700, manufactured by Kuraray Co., Ltd.), and ethylene vinyl acetate (product name: BE-585, manufactured by Japan Coating Resin Co., Ltd.)

Inkjet ink-fixing agent: polyamine epihalohydrin copolymer (product name: DK 6872, manufactured by Seiko PMC Corporation)

Organic spherical particles: acrylic beads (product name: art pearl GR-200, clear, average particle diameter D50=32.0 μm, manufactured by Negami Chemical Industrial Co., Ltd), acrylic beads (product name: art pearl GR-300, clear, average particle diameter D50=22.0 μm, manufactured by Negami Chemical Industrial Co., Ltd), acrylic beads (product name: art pearl G-400, clear, average particle diameter D50=15.0 μm, manufactured by Negami Chemical Industrial Co., Ltd), acrylic beads (product name: art pearl GR-600, clear, average particle diameter D50=10.0 μm, manufactured by Negami Chemical Industrial Co., Ltd), and Water-soluble metal salt: magnesium sulfate ($MgSO_4$).

The coating color was coated on one surface or both surfaces of the base paper using a bar blade coater such that a dry coating weight was 7.0 $g/m^2$ for each surface to provide an inkjet recording medium in each of Examples and Comparative Examples.

The average particle diameter D50 of the organic spherical particles was measured by the laser diffraction/scattering method (particle size distribution measuring device "Partica" manufactured by HORIBA, Ltd.).

Note that properties and evaluations of the ink-receiving layers on both surfaces in each of Examples and Comparative Examples are described in left and right sides of each column for one surface in Tables.

The inkjet recording medium provided in each of Examples and Comparative Examples was evaluated as follows and the results are shown in Table 1 and Table 2. Note that, in Table 1 and Table 2, when the ink-receiving layers were provided on both surfaces, printing qualities of respective surfaces are reported for each of Examples and Comparative Examples.

<Printing Quality>

Printing was performed by using the dye printer (product name: EP-306, manufactured by Seiko Epson Corporation, printing conditions: super fine paper, standard) and the pigment printer (product name: PX-5600, manufactured by Seiko Epson Corporation, printing conditions: super fine paper, fine).

Printing density Each inkjet recording medium produced was solid printed in cyan, magenta, yellow, and black, and was allowed to stand under the condition of 23° C. and 50% RH for 24 hours. Thereafter, the printing density of each image was measured using a reflection densitometer (Gretag Macbeth RD-19I). There is no practical problem in a case where total values of the printing density in four colors of dye ink are 4.50 or more and in a case where total values of the printing density in four colors of pigment ink are 4.60 or more.

Uneven Printing

Each inkjet recording medium produced was solid printed in green adjacent to each other (each size: 2 cm×3 cm) and was evaluated according to the following criteria. There is no practical problem in a case where the uneven printing is evaluated as 3 or 2.

3: Homogeneous solid without unevenness, no bleeding at a periphery of a solid portion 2: A little unevenness was observed partially but almost evenly solid, no bleeding at the periphery of the solid portion 1: Partial unevenness was observed, or bleeding at the periphery of the solid portion <Printer Conveyance Property>

Each sample was allowed to stand under the condition of 23° C./65% RH for 8 hours. Thereafter, 20 samples were set to and conveyed into an inkjet printer (product name: PIXUS MG7130, manufactured by Canon, Inc., Printing conditions: plain paper, high quality) under the condition of 23° C./50% RH or 30° C./80% RH. This was repeated five times, and a total of 100 inkjet recording media were conveyed and evaluated by the following criteria. There is no practical problem in a case where the evaluation was Excellent or Good.

<Multi-Feeding>

Excellent: No multi-feeding.

Good: Multi-feeding occurred on a total of 1 to 2 sheets of paper.

Bad: Multi-feeding occurred on a total of 3 or more sheets of paper.

<Empty Feeding>

Excellent: No empty feeding.

Good: Empty feeding occurred on a total of 1 to 2 sheets of paper.

Bad: Empty feeding occurred on a total of 3 or more sheets of paper.

TABLE 1

| | | | | Ink-receiving layer on one surface | | | | |
|---|---|---|---|---|---|---|---|---|
| | | | | Ex. 1 | Ex. 2 | Ex. 3 | Ex. 4 | Ex. 5 |
| Ink-receiving layer | Inorganic pigment | Gel silica | Parts | 70 | 70 | 70 | 70 | 70 |
| | | Precipitated silica | Parts | 30 | 30 | 30 | 30 | 30 |
| | Binder | PVA (A): polymerization degree 500 | Parts | 10 | 10 | 10 | 5 | 10 |
| | | PVA (B): polymerization degree 1700 | Parts | 25 | 30 | 25 | 25 | 25 |
| | | Ethylene vinyl acetate | Parts | 4 | 4 | 4 | 4 | 4 |
| | Inkjet ink-fixing agent | | Parts | 8 | 8 | 8 | 8 | 8 |
| | Organic spherical particles | D50: 32.0 μm | Parts | 0 | 0 | 0 | 0 | 3 |
| | | D50: 22.0 μm | Parts | 3 | 3 | 0 | 3 | 0 |
| | | D50: 15.0 μm | Parts | 0 | 0 | 3 | 0 | 0 |
| | | D50: 10.0 μm | Parts | 0 | 0 | 0 | 0 | 0 |
| | Water-soluble metal salt | $MgSO_4$ | Parts | 8 | 8 | 8 | 8 | 8 |
| Inkjet recording medium | | Basis weight (g/m$^2$) | | | | 101 | | |
| Printing quality | Dye ink | Printing density | Bk | 1.93 | 1.92 | 1.92 | 1.93 | 1.94 |
| | | | C | 0.41 | 0.40 | 0.40 | 0.41 | 0.41 |
| | | | M | 1.00 | 1.01 | 1.00 | 1.00 | 1.00 |
| | | | Y | 1.35 | 1.48 | 1.38 | 1.33 | 1.35 |
| | | | Total | 4.69 | 4.81 | 4.70 | 4.67 | 4.70 |
| | | Uneven printing | | 3 | 2 | 3 | 3 | 3 |
| | Pigment ink | Printing density | Bk | 1.66 | 1.64 | 1.65 | 1.66 | 1.66 |
| | | | C | 0.79 | 0.81 | 0.80 | 0.79 | 0.79 |
| | | | M | 1.03 | 1.06 | 1.04 | 1.03 | 1.03 |
| | | | Y | 1.24 | 1.28 | 1.24 | 1.22 | 1.24 |
| | | | Total | 4.72 | 4.79 | 4.73 | 4.70 | 4.72 |
| | | Uneven printing | | 3 | 3 | 3 | 3 | 3 |
| Printer conveyance property | | 23° C./50% RH | Multi-feeding | Excellent | Excellent | Excellent | Good | Excellent |
| | | | Empty feeding | Excellent | Excellent | Excellent | Excellent | Good |
| | | 30° C./80% RH | Multi-feeding | Excellent | Excellent | Good | Good | Excellent |
| | | | Empty feeding | Excellent | Excellent | Excellent | Excellent | Good |

TABLE 1-continued

| | | | | Ink-receiving layer on one surface | | | | |
|---|---|---|---|---|---|---|---|---|
| | | | | Ex. 6 | Ex. 7 | Comp. Ex. 1 | Comp. Ex. 2 | Comp. Ex. 3 |
| Ink-receiving layer | Inorganic pigment | Gel silica | Parts | 70 | 70 | 70 | 70 | 70 |
| | | Precipitated silica | Parts | 30 | 30 | 30 | 30 | 30 |
| | Binder | PVA (A): polymerization degree 500 | Parts | 10 | 10 | 0 | 10 | 10 |
| | | PVA (B): polymerization degree 1700 | Parts | 25 | 25 | 30 | 25 | 25 |
| | | Ethylene vinyl acetate | Parts | 4 | 4 | 4 | 4 | 4 |
| | Inkjet ink-fixing agent | | Parts | 8 | 8 | 8 | 8 | 8 |
| | Organic spherical particles | D50: 32.0 μm | Parts | 0 | 0 | 0 | 0 | 0 |
| | | D50: 22.0 μm | Parts | 6 | 1 | 0 | 0 | 0 |
| | | D50: 15.0 μm | Parts | 0 | 0 | 3 | 0 | 3 |
| | | D50: 10.0 μm | Parts | 0 | 0 | 0 | 3 | 0 |
| | Water-soluble metal salt | $MgSO_4$ | Parts | 8 | 8 | 8 | 8 | 0 |
| Inkjet recording medium | | Basis weight ($g/m^2$) | | | | 101 | | |
| Printing quality | Dye ink | Printing density | Bk | 1.92 | 1.94 | 1.89 | 1.93 | 1.90 |
| | | | C | 0.41 | 0.41 | 0.41 | 0.41 | 0.39 |
| | | | M | 1.00 | 1.00 | 1.00 | 1.00 | 0.99 |
| | | | Y | 1.35 | 1.35 | 1.42 | 1.34 | 1.37 |
| | | | Total | 4.68 | 4.70 | 4.72 | 4.68 | 4.65 |
| | | Uneven printing | | 3 | 3 | 3 | 3 | 3 |
| | Pigment ink | Printing density | Bk | 1.66 | 1.66 | 1.64 | 1.64 | 1.61 |
| | | | C | 0.79 | 0.79 | 0.79 | 0.79 | 0.77 |
| | | | M | 1.03 | 1.03 | 1.04 | 1.03 | 1.01 |
| | | | Y | 1.23 | 1.25 | 1.26 | 1.25 | 1.18 |
| | | | Total | 4.71 | 4.73 | 4.73 | 4.71 | 4.57 |
| | | Uneven printing | | 3 | 3 | 3 | 3 | 3 |
| Printer conveyance property | | 23° C./50% RH | Multi-feeding | Excellent | Excellent | Bad | Bad | Excellent |
| | | | Empty feeding | Good | Excellent | Excellent | Excellent | Excellent |
| | | 30° C./80% RH | Multi-feeding | Excellent | Good | Bad | Bad | Excellent |
| | | | Empty feeding | Excellent | Excellent | Excellent | Excellent | Excellent |

TABLE 2

| | | | | Ink-receiving layers on both surfaces | | | | | | | |
|---|---|---|---|---|---|---|---|---|---|---|---|
| | | | | Ex. 11 | | Ex. 12 | | Ex. 13 | | Ex. 14 | |
| Ink-receiving layer | Inorganic pigment | Gel silica | Parts | 70 | | 70 | | 70 | | 70 | |
| | | Precipitated silica | Parts | 30 | | 30 | | 30 | | 30 | |
| | Binder | PVA (A): polymerization degree 500 | Parts | 10 | | 10 | | 10 | | 5 | |
| | | PVA (B): polymerization degree 1700 | Parts | 25 | | 30 | | 25 | | 25 | |
| | | Ethylene vinyl acetate | Parts | 4 | | 4 | | 4 | | 4 | |
| | Inkjet ink-fixing agent | | Parts | 8 | | 8 | | 8 | | 8 | |
| | Organic spherical particles | D50: 32.0 μm | Parts | 0 | | 0 | | 0 | | 0 | |
| | | D50: 22.0 μm | Parts | 3 | | 3 | | 0 | | 3 | |
| | | D50: 15.0 μm | Parts | 0 | | 0 | | 3 | | 0 | |
| | | D50: 10.0 μm | Parts | 0 | | 0 | | 0 | | 0 | |
| | Water-soluble metal salt | $MgSO_4$ | Parts | 8 | | 8 | | 8 | | 8 | |
| Inkjet recording medium | | Basis weight ($g/m^2$) | | | | 108 | | | | | |
| Printing quality | Dye ink | Printing density | Bk | 1.91 | 1.92 | 1.89 | 1.91 | 1.92 | 1.90 | 1.91 | 1.92 |
| | | | C | 0.41 | 0.40 | 0.41 | 0.40 | 0.40 | 0.41 | 0.41 | 0.40 |
| | | | M | 1.00 | 0.99 | 1.01 | 1.01 | 1.00 | 1.00 | 1.00 | 0.99 |
| | | | Y | 1.31 | 1.27 | 1.42 | 1.43 | 1.31 | 1.30 | 1.30 | 1.27 |
| | | | Total | 4.63 | 4.58 | 4.73 | 4.75 | 4.63 | 4.61 | 4.62 | 4.58 |
| | | Uneven printing | | 3 | 3 | 2 | 2 | 3 | 3 | 3 | 3 |

TABLE 2-continued

| | | | | | | | | | | | |
|---|---|---|---|---|---|---|---|---|---|---|---|
| | Pigment ink | Printing density | Bk | 1.66 | 1.66 | 1.65 | 1.64 | 1.66 | 1.66 | 1.66 | 1.66 |
| | | | C | 0.79 | 0.78 | 0.80 | 0.80 | 0.79 | 0.79 | 0.79 | 0.78 |
| | | | M | 1.03 | 1.02 | 1.05 | 1.05 | 1.03 | 1.02 | 1.03 | 1.02 |
| | | | Y | 1.24 | 1.22 | 1.26 | 1.26 | 1.22 | 1.22 | 1.23 | 1.22 |
| | | | Total | 4.72 | 4.68 | 4.76 | 4.75 | 4.70 | 4.69 | 4.71 | 4.68 |
| | | Uneven printing | | 3 | 3 | 3 | 3 | 3 | 3 | 3 | 3 |
| Printer conveyance property | | 23° C./50% RH | Multi-feeding | Excellent | | Excellent | | Excellent | | Good | |
| | | | Empty feeding | Excellent | | Excellent | | Excellent | | Excellent | |
| | | 30° C./80% RH | Multi-feeding | Excellent | | Excellent | | Good | | Good | |
| | | | Empty feeding | Excellent | | Excellent | | Excellent | | Excellent | |

| | | | | Ink-receiving layers on both surfaces | | | | | |
|---|---|---|---|---|---|---|---|---|---|
| | | | | Ex. 15 | | Ex. 16 | | Ex. 17 | |
| Ink-receiving layer | Inorganic pigment | Gel silica | Parts | 70 | | 70 | | 70 | |
| | | Precipitated silica | Parts | 30 | | 30 | | 30 | |
| | Binder | PVA (A): polymerization degree 500 | Parts | 10 | | 10 | | 10 | |
| | | PVA (B): polymerization degree 1700 | Parts | 25 | | 25 | | 25 | |
| | | Ethylene vinyl acetate | Parts | 4 | | 4 | | 4 | |
| | Inkjet ink-fixing agent | | Parts | 8 | | 8 | | 8 | |
| | Organic spherical particles | D50: 32.0 μm | Parts | 3 | | 0 | | 0 | |
| | | D50: 22.0 μm | Parts | 0 | | 6 | | 1 | |
| | | D50: 15.0 μm | Parts | 0 | | 0 | | 0 | |
| | | D50: 10.0 μm | Parts | 0 | | 0 | | 0 | |
| | Water-soluble metal salt | $MgSO_4$ | Parts | 8 | | 8 | | 8 | |
| Inkjet recording medium | | Basis weight (g/m$^2$) | | 108 | | | | | |
| Printing quality | Dye ink | Printing density | Bk | 1.92 | 1.93 | 1.90 | 1.91 | 1.92 | 1.93 |
| | | | C | 0.41 | 0.40 | 0.41 | 0.40 | 0.41 | 0.40 |
| | | | M | 1.00 | 0.99 | 1.00 | 0.99 | 1.00 | 0.99 |
| | | | Y | 1.31 | 1.27 | 1.31 | 1.27 | 1.31 | 1.27 |
| | | | Total | 4.64 | 4.59 | 4.62 | 4.57 | 4.64 | 4.59 |
| | | Uneven printing | | 3 | 3 | 3 | 3 | 3 | 3 |
| | Pigment ink | Printing density | Bk | 1.66 | 1.66 | 1.66 | 1.66 | 1.66 | 1.66 |
| | | | C | 0.79 | 0.78 | 0.79 | 0.78 | 0.79 | 0.78 |
| | | | M | 1.03 | 1.02 | 1.03 | 1.02 | 1.03 | 1.02 |
| | | | Y | 1.24 | 1.22 | 1.23 | 1.22 | 1.25 | 1.23 |
| | | | Total | 4.72 | 4.68 | 4.71 | 4.68 | 4.73 | 4.69 |
| | | Uneven printing | | 3 | 3 | 3 | 3 | 3 | 3 |
| Printer conveyance property | | 23° C./50% RH | Multi-feeding | Excellent | | Excellent | | Excellent | |
| | | | Empty feeding | Good | | Good | | Excellent | |
| | | 30° C./80% RH | Multi-feeding | Excellent | | Excellent | | Good | |
| | | | Empty feeding | Good | | Excellent | | Excellent | |

| | | | | Ink-receiving layers on both surfaces | | |
|---|---|---|---|---|---|---|
| | | | | Comp. Ex. 11 | Comp. Ex. 12 | Comp. Ex. 13 |
| Ink-receiving layer | Inorganic pigment | Gel silica | Parts | 70 | 70 | 70 |
| | | Precipitated silica | Parts | 30 | 30 | 30 |
| | Binder | PVA (A): polymerization degree 500 | Parts | 0 | 10 | 10 |
| | | PVA (B): polymerization degree 1700 | Parts | 30 | 25 | 25 |
| | | Ethylene vinyl acetate | Parts | 4 | 4 | 4 |
| | Inkjet ink-fixing agent | | Parts | 8 | 8 | 8 |
| | Organic spherical particles | D50: 32.0 μm | Parts | 0 | 0 | 0 |
| | | D50: 22.0 μm | Parts | 0 | 0 | 0 |
| | | D50: 15.0 μm | Parts | 3 | 0 | 3 |
| | | D50: 10.0 μm | Parts | 0 | 3 | 0 |
| | Water-soluble metal salt | $MgSO_4$ | Parts | 8 | 8 | 0 |
| Inkjet recording medium | | Basis weight (g/m$^2$) | | 108 | | |

TABLE 2-continued

| | | | | | | | | | |
|---|---|---|---|---|---|---|---|---|---|
| Printing quality | Dye ink | Printing density | Bk | 1.88 | 1.89 | 1.91 | 1.91 | 1.89 | 1.88 |
| | | | C | 0.40 | 0.39 | 0.41 | 0.41 | 0.40 | 0.41 |
| | | | M | 1.00 | 1.00 | 1.01 | 0.99 | 1.01 | 0.99 |
| | | | Y | 1.43 | 1.40 | 1.30 | 1.29 | 1.32 | 1.33 |
| | | | Total | 4.71 | 4.68 | 4.63 | 4.60 | 4.62 | 4.61 |
| | | Uneven printing | | 3 | 3 | 3 | 3 | 3 | 3 |
| | Pigment ink | Printing density | Bk | 1.64 | 1.64 | 1.67 | 1.66 | 1.59 | 1.59 |
| | | | C | 0.79 | 0.78 | 0.78 | 0.78 | 0.77 | 0.76 |
| | | | M | 1.04 | 1.03 | 1.03 | 1.03 | 1.00 | 0.99 |
| | | | Y | 1.25 | 1.24 | 1.22 | 1.23 | 1.18 | 1.16 |
| | | | Total | 4.72 | 4.69 | 4.70 | 4.70 | 4.54 | 4.50 |
| | | Uneven printing | | 3 | 3 | 3 | 3 | 3 | 3 |
| Printer conveyance property | | 23° C./50% RH | Multi-feeding | Bad | | Bad | | Excellent | |
| | | | Empty feeding | Excellent | | Excellent | | Excellent | |
| | | 30° C./80% RH | Multi-feeding | Bad | | Bad | | Excellent | |
| | | | Empty feeding | Excellent | | Excellent | | Excellent | |

From Table 1 and Table 2, each Example had excellent printing quality and excellent printer conveyance property.

In each of Examples 4 and 14 in which the content of the polyvinyl alcohol (A) was under 10 parts by weight in the ink-receiving layer, multi-feeding occurred many times and the printer conveyance property was slightly low as compared to other Examples, but there is no practical problem.

Note that each of Examples 1, 2, 11, and 12 in which the organic spherical particles having the average particle diameter D50 of exceeding 20.0 μm were used had further excellent printer conveyance property under high temperature and high humidity conditions (30° C./80% RH) as compared to other Examples.

Furthermore, in each of Examples 5 and 15 in which the organic spherical particles having the average particle diameter D50 of exceeding 30.0 μm were used, the empty feeding occurred many times and the printer conveyance property was slightly low as compared to other Examples, but there is no practical problem.

In each of Examples 6 and 16 in which the content of the organic spherical particles was under 1.5 parts by weight in the ink-receiving layer, the empty feeding occurred many times and the printer conveyance property was slightly low as compared to other Examples, but there is no practical problem.

In each of Examples 7 and 17 in which the content of the organic spherical particles was exceeds 5.5 parts by weight in the ink-receiving layer, the empty feeding occurred many times and the printer conveyance property was slightly low as compared to other Examples, but there is no practical problem.

In contrast, in each of Comparative Examples 1 and 11 in which the ink-receiving layer did not contain the polyvinyl alcohol (A) with the polymerization degree of 700 or less, the printer conveyance property was low. It is conceivable that since the polyvinyl alcohol (A) was not contained, a coating of polyvinyl alcohol (B) was attached around the organic spherical particles, and the effect of decreasing the coefficient of friction of the ink-receiving layer was suppressed.

In each of Comparative Examples 2 and 12 in which the ink-receiving layer contained only the organic spherical particles having D50 of under 15.0 μm, the printer conveyance property was low. It is conceivable that since the organic spherical particles were small, the organic spherical particles were buried into the ink-receiving layer and had less chance to appear on the surface, and the effect of decreasing the coefficient of friction was insufficient.

In each of Comparative Examples 3 and 13 in which the ink-receiving layer did not contain the water-soluble metal salt, the printing quality was low when the pigment ink was used.

What is claimed is:

1. An inkjet recording medium for both dye ink and pigment ink printing, comprising an ink-receiving layer as an outermost layer containing an inorganic pigment, a binder, an inkjet ink-fixing agent comprising a cationic compound, and organic spherical particles disposed on at least one surface of a base paper, wherein the ink-receiving layer further contains a water-soluble metal salt and 5 parts by weight or more to 15 parts by weight or less of polyvinyl alcohol (A) with a polymerization degree of 700 or less and 20 parts by weight or more to 40 parts by weight or less of polyvinyl alcohol (B) with a polymerization degree of 1200 or more and 1700 or less as the binder with respect to 100 parts by weight of the ink-receiving layer; wherein a polyvinyl alcohol with a polymerization degree of beyond 1700 is not included, a volume 50% average particle diameter (D50) as measured by a laser diffraction/scattering method of the organic spherical particles exceeds 20.0 μm and is 35.0 μm or less, and wherein a dry coating weight of the ink-receiving layer is 4 $g/m^2$ to 10 $g/m^2$ for one surface.

2. The inkjet recording medium according to claim 1, wherein the volume 50% average particle diameter (D50) of the organic spherical particles exceeds 22.0 μm and is 30.0 μm or less.

3. The inkjet recording medium according to claim 1, wherein 0.5 parts by weight or more to 7 parts by weight or less of the organic spherical particles are contained with respect to 100 parts by weight of the inorganic pigment.

4. The inkjet recording medium according to claim 1, wherein a cation of the water-soluble metal salt is one selected from the group consisting of a magnesium ion, a calcium ion, and an aluminum ion, and an anion is one selected from the group consisting of a sulfate ion, a nitrate ion, and a chloride ion.

5. The inkjet recording medium according to claim 1, wherein 3 to 15 parts by weight of the water-soluble metal salt is contained with respect to 100 parts by weight of the ink-receiving layer.

6. The inkjet recording medium according to claim 1, wherein the inorganic pigment contains synthesized amorphous silica with a volume 50% average particle diameter (D50) of 6 to 14 μm, and the synthesized amorphous silica occupies 60% by weight of the inorganic pigment.

7. The inkjet recording medium according to claim 1, wherein the ink-receiving layer is disposed on both surfaces of the base paper.

8. The inkjet recording medium according to claim 2, wherein 0.5 parts by weight or more to 7 parts by weight or less of the organic spherical particles are contained with respect to 100 parts by weight of the inorganic pigment.

9. The inkjet recording medium according to claim 2, wherein a cation of the water-soluble metal salt is one selected from the group consisting of a magnesium ion, a calcium ion, and an aluminum ion, and an anion is one selected from the group consisting of a sulfate ion, a nitrate ion, and a chloride ion.

10. The inkjet recording medium according to claim 2, wherein 3 to 15 parts by weight of the water-soluble metal salt is contained with respect to 100 parts by weight of the ink-receiving layer.

11. The inkjet recording medium according to claim 2, wherein the inorganic pigment contains synthesized amorphous silica with a volume 50% average particle diameter (D50) of 6 to 14 μm, and the synthesized amorphous silica occupies 60% by weight of the inorganic pigment.

12. The inkjet recording medium according to claim 2, wherein the ink-receiving layer is disposed on both surfaces of the base paper.

13. The inkjet recording medium according to claim 3, wherein a cation of the water-soluble metal salt is one selected from the group consisting of a magnesium ion, a calcium ion, and an aluminum ion, and an anion is one selected from the group consisting of a sulfate ion, a nitrate ion, and a chloride ion.

14. The inkjet recording medium according to claim 3, wherein 3 to 15 parts by weight of the water-soluble metal salt is contained with respect to 100 parts by weight of the ink-receiving layer.

15. The inkjet recording medium according to claim 3, wherein the inorganic pigment contains synthesized amorphous silica with a volume 50% average particle diameter (D50) of 6 to 14 μm, and the synthesized amorphous silica occupies 60% by weight of the inorganic pigment.

16. The inkjet recording medium according to claim 3, wherein the ink-receiving layer is disposed on both surfaces of the base paper.

17. The inkjet recording medium according to claim 4, wherein 3 to 15 parts by weight of the water-soluble metal salt is contained with respect to 100 parts by weight of the ink-receiving layer.

18. The inkjet recording medium according to claim 4, wherein the inorganic pigment contains synthesized amorphous silica with a volume 50% average particle diameter (D50) of 6 to 14 μm, and the synthesized amorphous silica occupies 60% by weight of the inorganic pigment.

19. The inkjet recording medium according to claim 4, wherein the ink-receiving layer is disposed on both surfaces of the base paper.

* * * * *